US005125550A

United States Patent [19]

Scribner

[11] Patent Number: 5,125,550

[45] Date of Patent: Jun. 30, 1992

[54] PNEUMATICALLY OPERATED FEEDER FOR STRIP STOCK

[76] Inventor: Albert W. Scribner, 6 Country Club Rd., Darien, Conn. 06820

[21] Appl. No.: 542,526

[22] Filed: Jun. 25, 1990

[51] Int. Cl.[5] ..... B65H 23/06

[52] U.S. Cl. ..... 226/150; 226/158

[58] Field of Search ..... 226/197, 149, 150, 158, 226/159, 143, 137, 167

[56] References Cited

U.S. PATENT DOCUMENTS

| | | | |
|---|---|---|---|
| 1,001,606 | 8/1911 | Baumgartner | 226/137 X |
| 2,406,508 | 8/1946 | Papsdorf | 226/137 X |
| 2,657,046 | 10/1953 | Tallis | 226/150 X |
| 2,703,711 | 3/1955 | hilton | 226/149 |
| 3,038,645 | 6/1962 | Nordloff | 226/149 |
| 3,329,327 | 7/1967 | Scribner | 226/150 |
| 3,580,449 | 5/1971 | Chaban | 226/150 |
| 4,081,987 | 10/1977 | Scribner | 226/159 X |
| 4,223,821 | 9/1980 | McCall | 226/150 X |
| 4,261,238 | 4/1981 | Scribner | 226/150 X |
| 4,329,897 | 5/1982 | Scribner | 226/150 X |
| 4,513,899 | 4/1985 | Ledgerwood | 226/150 X |
| 4,619,390 | 10/1986 | Scribner | 226/150 X |
| 4,669,645 | 6/1987 | Nordlof | 226/150 X |
| 4,753,381 | 6/1988 | Nordlof | 226/150 X |

*Primary Examiner*—Daniel P. Stodola
*Assistant Examiner*—P. Bowen

[57] ABSTRACT

A pneumatic device for intermittently advancing stock into the work station of a punch press and having a dual cylinder arrangement on the feed slide block for moving a lower stock gripping jaw into engagement with the stock to be fed, and a dual cylinder arrangement in the main block for actuation the feed slide in a stock feed direction; the piston rods of the latter dual cylinders affording separate fluid conduits for respectively supplying pressure fluid first to the cylinders on the feed slide block and secondly to a buffer unit on the feed slide that is adapted to cushion the terminal portion of the movement of the feed slide in a non-feed direction. Also an arrangement is provided for removably securing to the main block to the feeder a bridge block which houses a substantial portion of the feeder control valving and also a stock clamper whereby the control valving and the stock clamper controls for the feeder may be readily removed for replacement of repair purposes. Further, a large internal pressure fluid reservoir or capacitance is provided in the main feeder block or frame so as to afford an immediately available large volume of pressure fluid for the fluid motors of the feeder.

2 Claims, 4 Drawing Sheets

PNEUMATICALLY OPERATED FEEDER FOR STRIP STOCK

BACKGROUND OF THE INVENTION

Present pneumatic stock feeders capable of handling metal strip stock having widths of twelve inches or greater characteristically require very heavily constructed moving feed slides and related parts in order to operationally accommodate the relatively high operational forces involved, e.g. stock gripping forces of 1000 pounds and higher and feed forces of 200 pounds and higher. Such heavy construction obviously adversely affects not only the mechanical response times and the subsequent speed of operation, but also the manufacturing and other costs of such feeders. Further these larger feeders have for the most part just one control mode of operation and are not capable of being readily shifted to another control mode or having at last a substantial portion of the entire control circuitry removable from the feeder, as a unit, for repairs or replacement.

SUMMARY OF THE INVENTION

The present invention contemplates an improved mechanical construction and arrangement for the feed slide, the feed slide pulling or actuating means, and the multiple pressure fluid supply lines to the feed slide. Further the present invention presents a new interchangeable system for housing at least a substantial portion of the control circuitry for the present feeder.

The primary object of this invention is to provide a pneumatically operated stock feeder which has an improved construction that affords faster response times to control valve shifts by reason of having relatively light weight moving parts, a large internal reservoir of pressure fluid and a compact arrangement for the control circuitry.

Another object of the invention is to provide an improved pneumatic feeder affording a large quick response feed force by reason of having two main feed pistons and a relatively light composite feed slide that utilizes a slide block comprised of a light weight material such as aluminum, and stiffener plates, made of high strength material such as steel or the like, that are secured on the fore and aft sides of said slide block.

Another object of the invention is to provide a compact assembly for the feeder control circuitry whereby a substantial portion of the pneumatically controlled valves and the interconnecting conduit lines are disposed in mutually close relation and are capable of being readily removed from the feeder as a unit for repair or replacement purposes.

A further object of the invention is to provide a novel means for facilitating the release of the stock clamping means when piloted dies are used in the press with which the present feeder is used.

Other objects of the invention will become apparent as the disclosure progresses.

DETAILED DESCRIPTION OF THE INVENTION

Figure 1:
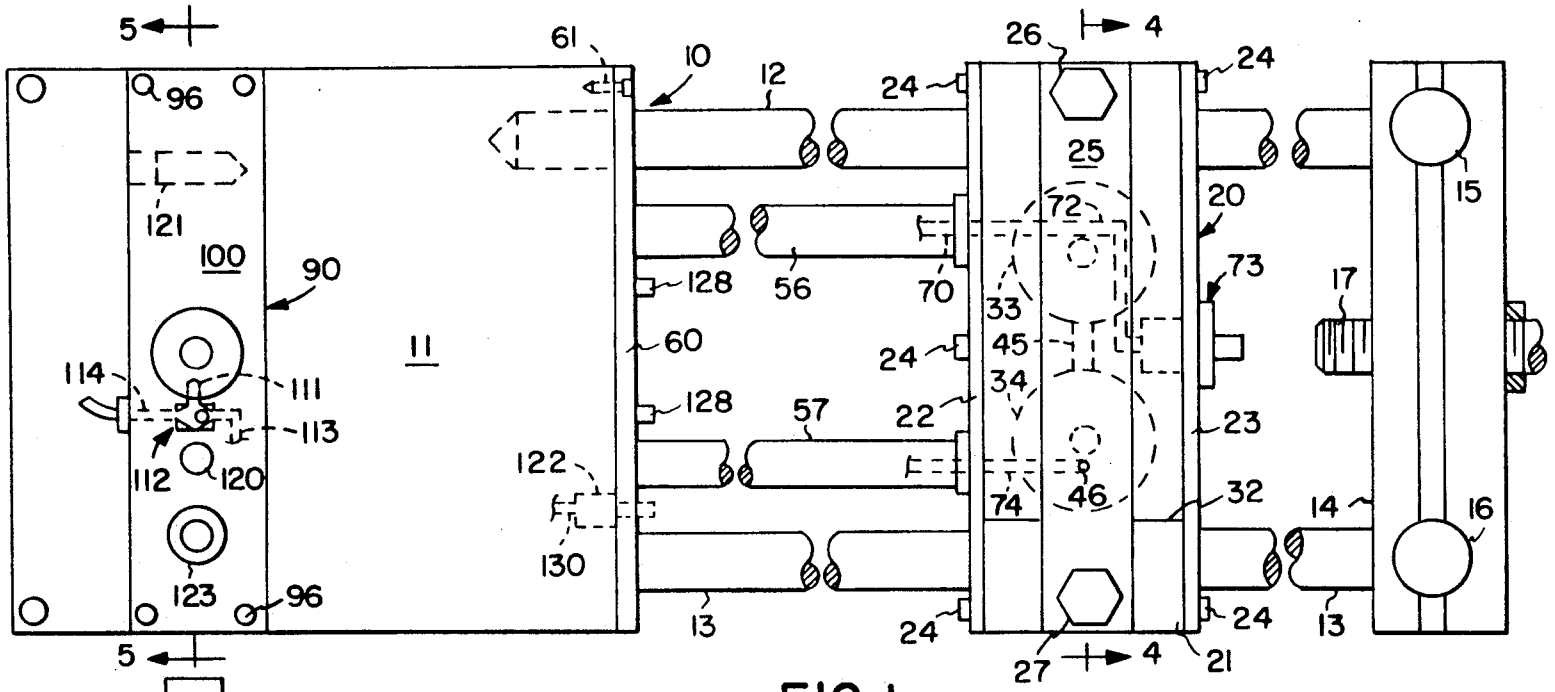
FIG. 1 is an overall plan view of the present feeder.
Figure 2:
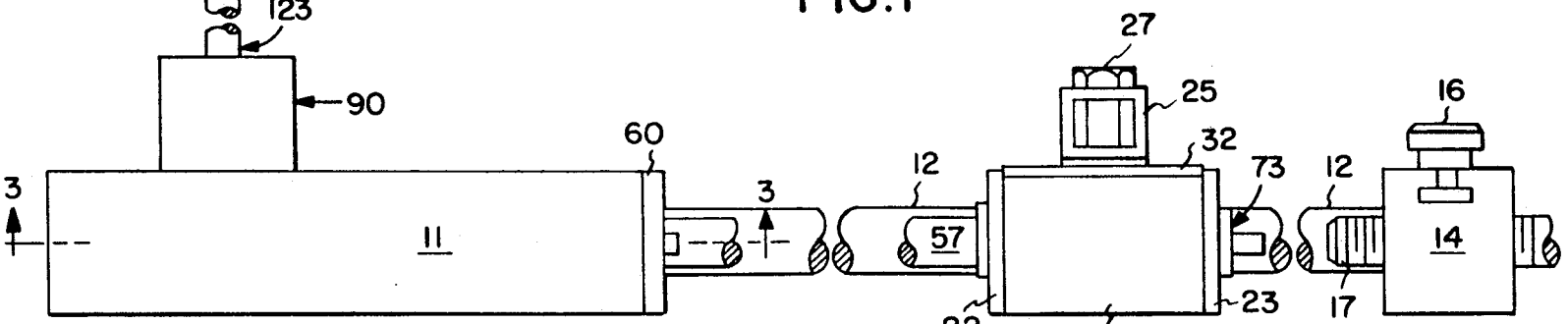
FIG. 2 is a front elevational view of the feeder illustrated in FIG. 1.

Referring to FIGS. 1 and 2 the present feeder comprises a frame 10 that includes a main body or block 11 having two parallel circular cross-sectioned rails 12 and 13 secured thereto by any suitable means. An end block 14 is adjustably secured to the outer ends of said rails and is provided with the usual laterally adjustable stock guide rollers 15 and 16 as well as a conventional type feed stroke adjusting screw 17, the construction and operation thereof being well understood in the art. Slidably mounted on the rails 12 and 13 is a feed slide 20 comprising slide block 21 made of a light weight material such as aluminum and a pair of stiffener plates 22 and 23 made from a high strength material such as steel; said plates being secured to the fore and aft faces respectively of said slide block 21 by any suitable fastening means such as screws 24. A fixed upper stock gripping jaw 25, FIGS. 1, 2 and 4 is secured at each end thereof to the slide block 21 by heavy screws 26 and 27; said jaw being maintained in fixed spaced relation with respect to the top surface of slide block 21 by the spacers 30 and 31 disposed beneath jaw 25, FIG. 4, and through which said screws 26, 27 pass.

Figure 4:
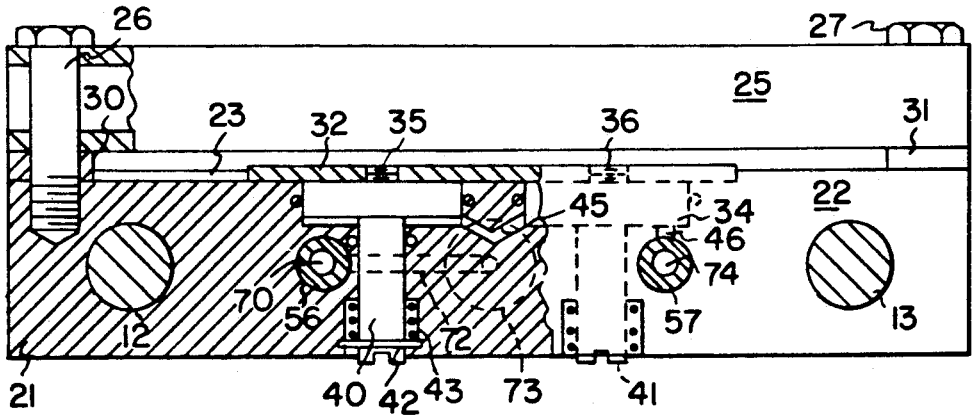
FIG. 4 is an elevational view in partial section taken along section line 4—4 of FIG. 1.

A vertically movable lower stock gripping jaw 32, FIG. 4, is disposed immediately above the upper surface of the slide block 21 and between the stiffener plates 22 and 23, FIG. 2, and is adapted to be actuated upwardly by a pair of pistons 33, 34 carried in cylinders formed in the upper portion of the slide block. The lower movable jaw 32 is connected to the said two pistons by any suitable means such as by the reduced threaded upper ends 35, 36, FIG. 4, respectively formed on the upper sides of said pistons. The pistons 33 and 34 are respectively provided with integral depending piston rods 40 and 41; each of the latter being provided with a lower snap-ring such as shown at 42, FIG. 4. A compression spring 43 is operatively disposed between the slide block and the said snap-ring on each piston; said springs serving to downwardly bias said pistons so that the lower stock gripping jaw 32 moves to its open or stock release position. The slide block cylinders for pistons 33 and 34 are pneumatically interconnected by a fluid conduit line 45 as shown in FIGS. 1 and 4. A conduit line 46, FIGS. 1 and 4, formed in slide block 21 communicates with the bottom of the cylinder for piston 34. As will be apparent when pressure fluid is introduced into said line 46 both pistons 33 and 34 will elevate the lower stock gripping jaw 32 to its upper of stock gripping condition.

Figure 3:
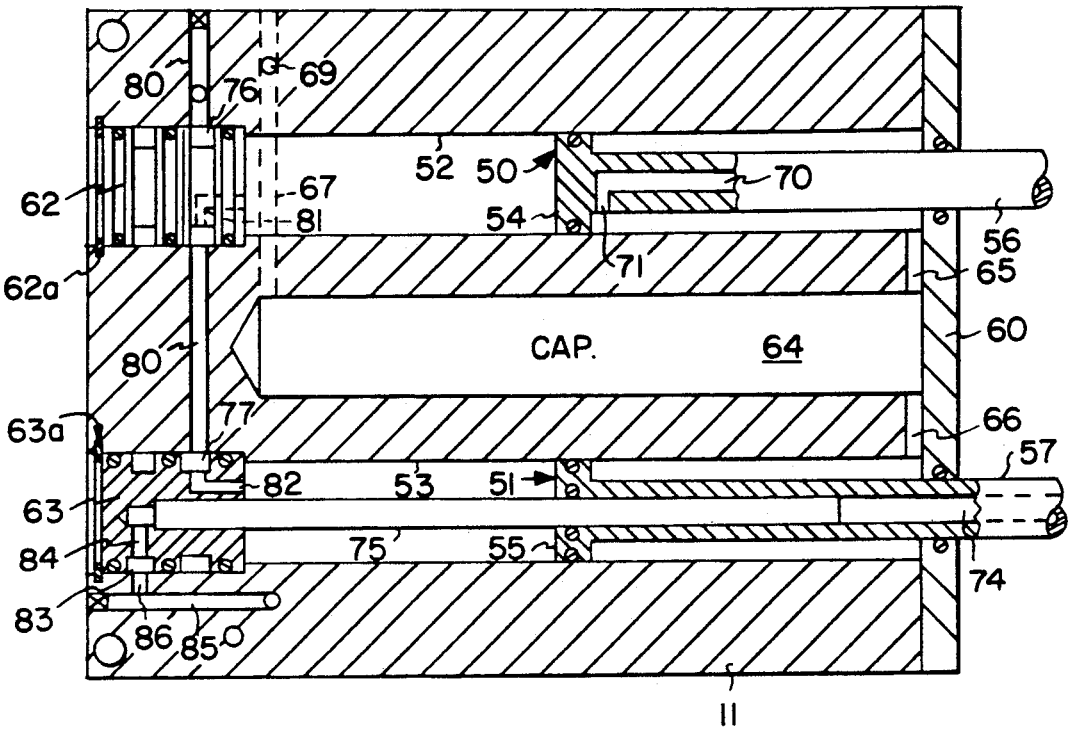
FIG. 3 is a horizontal sectional view of the main block of the feeder taken along section line 3—3 of FIG. 2.

The feed slide 20 is adapted to be reciprocated in feed and index directions by a pair of main fluid motors 50 and 51, FIG. 3, which respectively comprise cylinders 52 and 53 formed in the main block 11 and associated pistons 54 and 55 respectively slidably disposed in said cylinders. Piston rods 56 and 57 are respectively connected at their left ends (as seen in FIG. 3) to said pistons 54, 55 and at their right or outer ends to the slide block 21, using any suitable fastening means such as threaded connections as is well understood in the art. The right hand ends (as seen in FIG. 3) of said main cylinders are closed by a cover plate 60 that is secured to said main body 11 by any suitable means such as a plurality of screws as illustrated at 61 of FIG. 1. The left end of said main cylinders are respectively closed by means of a pair of peripherally grooved plugs 62 and 63, FIG. 3, which are secured in cylindrical recesses respectively formed in the main block by any suitable means such as internal snap-rings 62*a* and 63*a* respectively.

Figure 5:
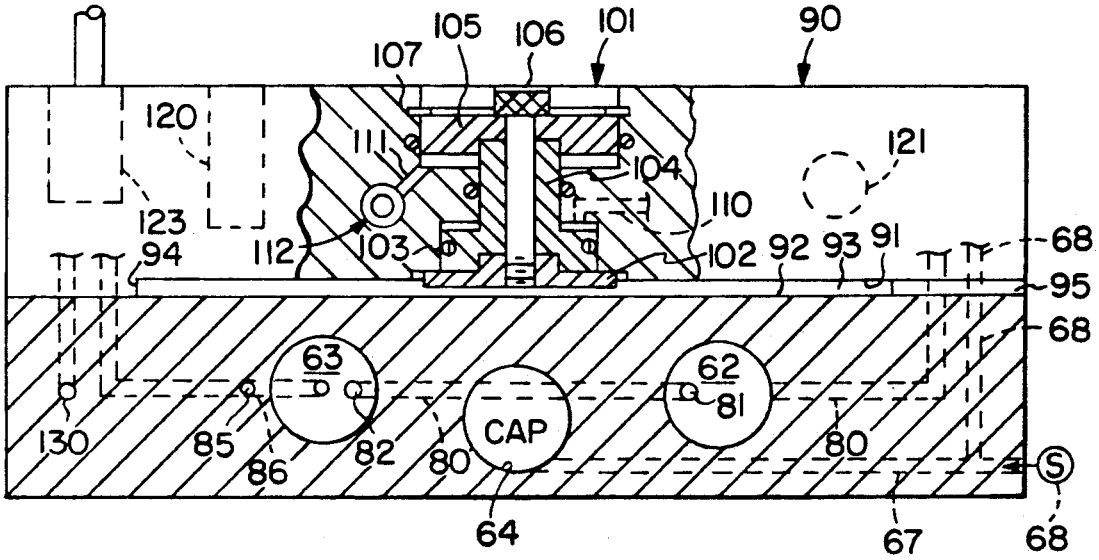
FIG. 5 is an elevational view taken in partial section along section line 5—5 of FIG. 1.

A large cylindrical chamber 64 formed in the main block 11 affords a very substantial internal pneumatic capacitance, the right hand end (as seen in FIG. 3) of said chamber 64 being closed by said cover plate 60 and being pneumatically interconnected with the rod ends of the main cylinders 52, 53 through horizontally extending slots 65 and 66 formed in the adjacent end face of the main block. As may be seen from FIGS. 3 and 5 the chamber or bore 64 has a circular cross sectional shape and an axis that extends substantially parallel to the axes for the main cylinders 52 and 53. Both the main cylinders 52 and 53 along with the capacitance bore 64 extend into the main block 11 from the same end face of said main block and are closed at said end face by said cover plate 60. A fluid conduit line 67, FIG. 5, is formed in the main block 11 and communicates between the inner end of said capacitance chamber 64 and an external source 68 of pressure fluid. A conduit line 69 extends upwardly through the block 11 from line 67 and into the hereinafter described bridge block 100 so as to be capable of constantly supplying pressure fluid to the control valves in said bridge block.

The piston rod 56, FIG. 3, is formed with an axially extending fluid conduit line 70 that at its left end (as seen in FIG. 3) communicates with a radially disposed conduit line 71, formed through the wall of the tubular piston rod 56 and at its other or right end communicates with one end of a fluid conduit line 72, FIG. 1 and 4, that is formed in said slide block. The other end of said line 72 is coupled to and communicates with a conventional type fluid operated buffer unit 73 carried by said feed slide 20; the construction and operation of said buffer unit being conventional in nature and well understood in the art. The other tubular main piston rod 57 is formed with an axially extending fluid conduit line 74, FIG. 3; the left end (as seen in FIG. 3) thereof telescopically receiving a tube 75; the left end of the latter being secured (as by a press fit) in the center of said end plug 63.

The plugs 62 and 63 have mutually laterally aligned peripheral grooves 76 and 77 respectively formed therein so that a fluid conduit line 80, FIG. 3, formed in the main block 11 can supply and exhaust pressure fluid to and from the head end of the main cylinders through fluid conduit lines 81 and 82 respectively formed in said plugs 62 and 63. The plug 63 is formed with a second peripheral groove 83, FIG. 3, which communicates with the left end (as seen in FIG. 3) of the said tube 75 through a fluid conduit line 84 formed in said plug 63 whereby pressure fluid may be supplied and exhausted to and from the said stock gripping fluid motors on said feed slide 20 from and through fluid conduit lines 85 and 86 formed in the main block 11; line 85 communicating with the control circuitry in the said bridge block 100. Suitable 0-rings or other type seals are provided on the peripheries of plugs 62, 63 in order to prevent peripheral fluid leakage from said plugs.

The feeder is provided with a transversely disposed bridge assembly or unit 90 as is best illustrated in FIGS. 1, 2 and 5; the bottom surface 91 of the unit being closely spaced from and above the top surface 92 of the main block so as to define a stock feed passage 93, FIG. 5, that extends longitudinally along the top of the main block. This fixed spaced relation is maintained by means of integral feet 94 or spacer pads 95 located at the lower side at each end of the said bridge unit as illustrated in FIG. 5. The bridge unit 90 which is secured to the main block 11 by any suitable fastening means such as by four corner screws 96 illustrated in FIG. 1 houses a substantial portion all of the feeder control circuitry as well as a stock clamping means. The bridge unit 90 comprises a bridge block or body 100 which carries a double acting fluid motor 101, FIG. 5, that is adapted to actuate an upper movable stock clamping jaw 102. Jaw 102 is mounted on the lower face of a piston 103 that is disposed in a cylinder formed in the lower portion of the bridge block 100, said piston 103 having an integral upwardly extending piston rod 104 at the top of which is mounted an upper larger piston 105 that is disposed in a correspondingly sized cylinder formed in the upper portion of the bridge body 100. The clamping jaw 102, piston 103, piston rod 104 and piston 105 are all axially secured together as a unit by means of a socket head screw 106 that has an upper head that engages the top of piston 105 and a threaded lower end that threadedly engages the said clamping jaw 102. An internal snap-ring 107 prevents piston 105 from blowing upwardly and out should screw 106 ever become excessively loosened.

A fluid conduit line 110, FIG. 5, is formed in bridge block 100 so that constant pressure fluid from said fluid supply 68 may be continuously supplied to the upper surface of piston 103. A fluid conduit line 111, FIGS. 1 and 5, is formed in the bridge block so as to communicate between the output of a conventional ball type shuttle valve 112 carried by the bridge block and the lower side of piston 105. Pressure fluid may be directed by the shuttle valve 112 into line 111 from either a line 113 or a line 114, FIGS. 1 and 6 formed in the bridge block. The line 113 is from the normal feeder control circuit as will be explained in connection with FIG. 6, while line 114 is from an external control such as a conventional three way valve 115, FIG. 6, that is operated by a cam 116 coupled to and operated by the press ram in a manner well understood in the art so that at the desired point in the downstroke of the press ram the valve 115 is opened to cause pressure fluid to flow into line 114 into line 111 and to thus shift the shuttle valve and direct pressure fluid beneath piston 105; the latter having an effective cross sectional area greater than that of the constantly downwardly pressure biased piston 103. This arrangement and action affords a stock clamp release action for the clamp jaw 102 where piloted dies and the cam 116 and valve 115 are being used in the press that is being fed by the instant feeder.

Figure 6:
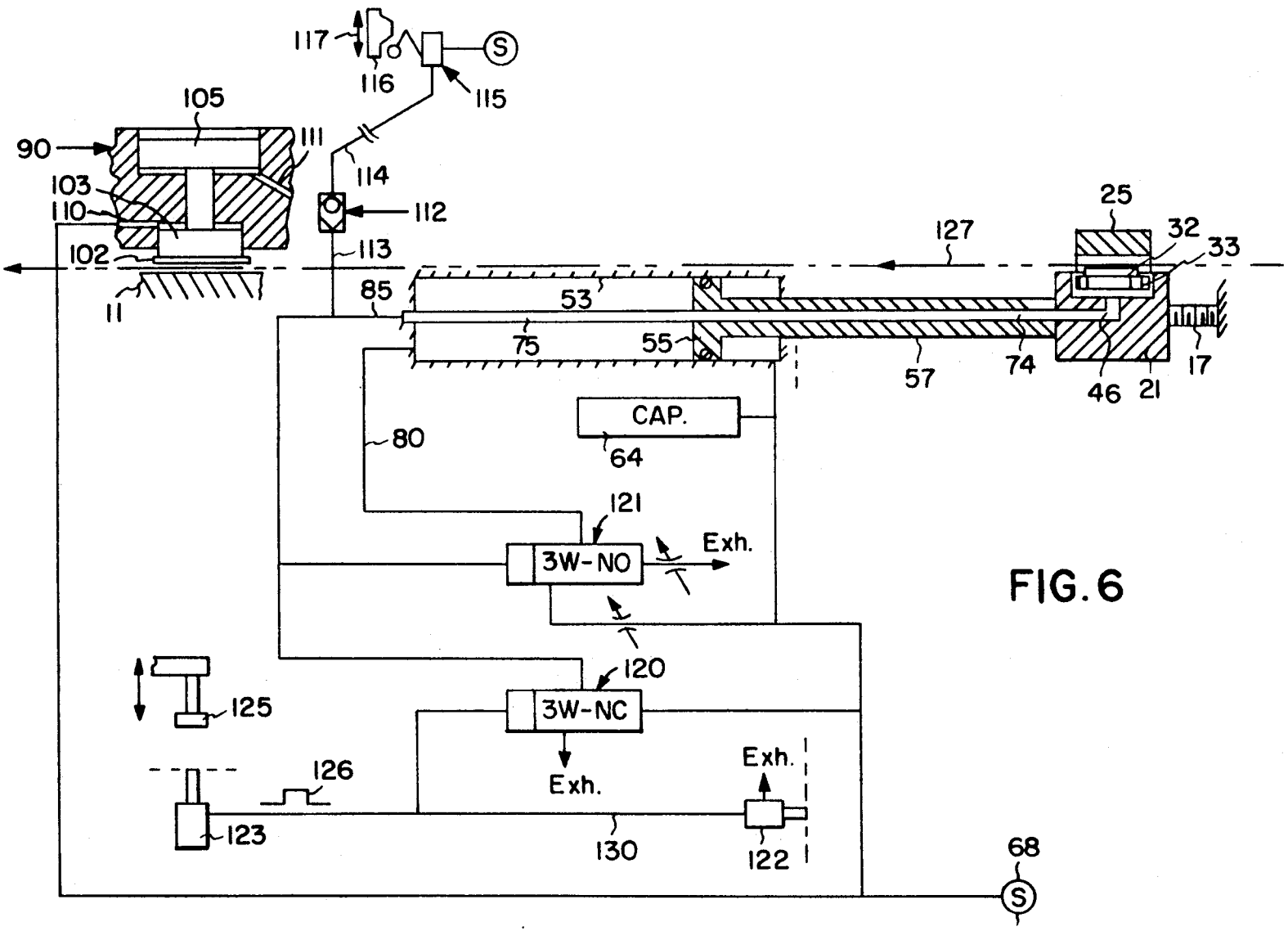
FIG. 6 comprises a circuit diagram for a semi-automatic control system for the present feeder.

The control circuit for the present feeder is illustrated in FIG. 6. This circuit and its components are substantially the same in construction and operation as those disclosed in my prior U.S. Pat. No. 4,329,897 the disclosure of which is incorporated herein by reference. The additions in the FIG. 6 circuit being the above described shuttle valve control feature for piloted dies, and the provision of the large internal capacitance chamber 64, FIGS. 3 and 6 formed in the main block 11. In that the common or similar portions of the FIG. 6 circuit and the circuit in said patent are fully described in said patent no further description thereof here is necessary.

In the FIG. 6 circuit diagram the normally closed valve 120 may comprise an air piloted three way valve that is commercially available as Model Y-125 from the Humphrey Valve Co. of Kalamazoo, Mich. while the normally open valve 121 may comprise an air piloted three way valve that is also commercially available as Model Y-250 from the same company. The construction and operation of the reverse valve 122 and the trigger valve 123 are the same as disclosed in said Patent. The physical locations of the valves 120, 121, 123 are in the bridge block 100 as indicated in FIGS. 1 and 5; such valves being interconnected by any suitable fluid conduit lines formed in the bridge block (e.g. by conventional drilling etc. so as to define the related portion of the circuit shown in FIG. 6 as is well understood in the art. In this way a substantially portion of the control valving and circuitry for the feeder are disposed in the bridge block 100 whereby if circuit repair or replacement thereof is needed or desired the bridge block may be readily removed by removing the said mounting screws 96 therefor and replacing the same with a new similar bridge block or with a bridge block having a different control circuit therein. If a new circuit does not require use of the reverse valve 122 in the main block then the new bridge block need not be provided with a fluid conduit line leading to the line 130, FIGS. 1, 5 and 6, in the main block which serves said reverse valve: this latter valve then being redundant.

A cursory description of the operation of the present control circuit will now be made with reference to FIG. 6. In the normal condition of the feeder the feed slide 20 is in an indexed position against the feed stroke adjusting screw 17: the lower gripping jaw 32 on the feed slide then being in a stock release condition while the upper stock clamping jaw 102 on the bridge block being in a stock clamping condition. When the associated press ram moves its usual striker 125, FIG. 6, into engagement with the plunger of the trigger valve 123 nothing happens on the striker downstroke, however upon the upward stroke or movement of the striker the said trigger valve 123 will initiate a pulsed pressure fluid signal as indicated at 126 so that said stock gripping and clamping jaws change their respective operative conditions and then a feed stroke of slide 20 is initiated so that the stock to be fed is incrementally advanced along the stock feed path 127, FIG. 6, through the feeder and into the work station of the press. The terminal portion of the feed stroke is cushioned by any well known type of buffer means as indicated at 128 of FIG. 1. Simultaneously the operative engagement of the feed slide with the reverse valve 122 causes the latter to be shifted whereupon the operative condition of said gripping and clamping jaws are again respectively changed and an index or non-feed stroke of the feed slide is then initiated so that the feed slide moves back to its said normal FIG. 6 condition. During this index stroke the clamp jaw 102 securely holds the stock against any fore or aft random movement; the pressure fluid beneath the larger piston 105 having been exhausted to allow the constant air bias above the smaller piston 103 to clamp the stock. If further details of the nature of the operation of the said control circuit are desired reference may be made to my said prior Patent. In piloted dies applications where it is desired to have the clamping jaw 102 momentarily release the stock for the usual piloting action the control valve and cam arrangement 115, 116 may be utilized to pressurize the release piston 105 through the shuttle valve 112 at a time just prior to the press punch entering the stock; the timing for this piloting action being well understood in the art.

The two added features in the FIG. 6 circuit herein comprise (a) the provision of the above described shuttle valve arrangement 112 which efficiently facilitates the use of the present feeder in those press operations where piloted dies are used and an associated stock clamping release action is desired, and (b) the provision in the main block 11 of a large internal capacitance chamber 64 which presents a close-by readily available reservoir of pressure fluid for the rod ends of the main feed pistons. This latter provision affords easier "breathing" for the rod ends of the main cylinders as opposed to the relatively high impedance of standard fluid conduit lines, and also promotes quick starts and faster actions in response to the control circuitry calling for a stock feed stroke for the present feeder. Similarly during the index or non-feed stroke of the feed slide less resistance to the forced outward flow of pressure fluid from the rod ends of the main cylinders will be encountered as compared to the higher fluid flow impedance of the usual sized flow lines; this making for a quick and rapid response to a signal calling for an index stroke of the present feeder.

The provision of the bridge unit or assembly 90 which contains most of the valving and control lines for the FIG. 6 circuit may be readily removed and replaced by another similar or different control circuit if such repair or change of control is needed or desired. The provision of two main feed pistons not only makes high feed forces possible but allows one of the main piston rods to conduct constant pressure fluid to the buffer unit on the feed slide while the other main piston rod conducts fluid pressure to and from the two stock gripping fluid motors on the feed slide. The composite arrangement for the feed slide, i.e. The light slide block 21 and the strong stiffener plates 22, 23 and the square cross section tubular fixed grip jaw makes possible a very rigid but relatively light feed slide assembly thus again facilitating quicker starts and faster actions in response to feed and index signals from the control circuitry.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

I claim:

1. A feeder for intermittently advancing stock into a work station: comprising a main block;

a pair of parallel rails connected to and extending away from said main block;

an end block connected to the outer ends of said rails;

a feed slide movably mounted on said rails for reciprocating movement in feed and index directions;

a pneumatic buffer unit carried by said feed slide for cushioning the terminal portion of the feed slide movement in an index direction;

stock gripping means carried by said feed slide and including a transverse upper jaw that is fixedly mounted on said feed slide, and a lower jaw that is mounted so as to move upwardly towards and downwardly away from said fixed upper jaw;

spring means for normally yieldably biasing said movable jaw downwardly towards a lower stock release position;

a first motor means including first and second parallel main pneumatic motors disposed in said main block and each having a piston and a piston rod, the respective outer ends of said piston rods being connected to said feed slide so as to be capable of reciprocally actuating said feed slide;

a second motor means including a pair of pneumatic motors carried by said feed slide and adapted to move said lower jaw upwardly towards said fixed upper jaw so as engage and grip the lower surfaces of stock to be fed;

a first pressure fluid conduit means for pneumatically interconnecting said pneumatic buffer unit on said feed slide with the rod end of said first main pneumatic motor in said main block and including a continuous air line formed (a) in said feed slide from the said buffer unit to the outer end of the piston rod of said first main pneumatic motor, (b) longitudinally from the outer end and through most of the length of the last mentioned piston rod, and (c) laterally through an aperture formed through the side wall of said last mentioned piston rod at a point adjacent the piston of said first main pneumatic motor whereby pressure air may be continuously supplied from said rod end of said first main pneumatic motor to said pneumatic buffer unit on the feed slide; a second separate pressure fluid conduit means formed (a) in said feed slide and extending from said pair of pneumatic motors on said feed slide to the outer end of the piston rod of said second main pneumatic motor, and (b) longitudinally through the length of the piston rod of the said second main pneumatic motor whereby pressure air may be supplied and exhausted through the last mentioned piston rod to and from said pair of pneumatic motors on said feed slide so that said lower jaw may be respectively moved up into and down out of gripping engagement with the lower surfaces of stock being fed through said feeder;

a bridge member mounted on said main block and extending laterally across the top of said main block;

a stock clamping jaw carried by and at the lower portion of said bridge member and adapted to respectively move downwardly into and upwardly out of clamping engagement with the top surfaces of stock being fed through the feeder;

a third motor means including a pneumatic motor carried by said bridge member for actuating said stock clamping jaw between stock release and stock clamping positions with respect to the top surfaces of stock being fed through the feeder; and pneumatic valve means for controlling said three motor means, at least some of said valve means being operatively disposed in said bridge member.

2. In a pneumatically operated feeder for intermittently advancing stock into a work station and having a main block;

a pair of parallel rails connected to and extending away from the inner end of said main block;

an end block connected to the outer ends of said rails;

a feed slide mounted on said rails for reciprocating movement in feed and index directions;

stock gripping means carried by said feed slide;

a first pneumatic motor means carried by said main block and including at least one main air cylinder, a piston and a piston rod for reciprocally actuating said feed slide;

a second pneumatic motor means carried by said feed slide for actuating said stock gripping means between stock release and stock gripping positions; and pneumatic valve means for controlling the operation of sid first and second pneumatic motor means;

the improvement comprising a large internal air capacitance system for said first pneumatic motor means and including walls in said main block defining an elongated cylindrical bore;

said cylindrical bore extending substantially parallel to said main cylinder and having a circular cross sectional profile;

said bore and said main air cylinder each extending into said main block from the same end face of said main block;

cover plate means closing the adjacent outer ends of said bore and main cylinder; and a fluid conduit line formed in said main block for continuously pneumatically connecting said cylindrical air capacitance bore to said first pneumatic motor means in said main block.

* * * * *